US010641036B2

(12) United States Patent
Fan et al.

(10) Patent No.: US 10,641,036 B2
(45) Date of Patent: May 5, 2020

(54) PANEL UNIT WITH MULTIPLE INTEGRATED AND COMMONLY ADJUSTABLE BLIND ASSEMBLIES

(71) Applicant: ODL, INCORPORATED, Zeeland, MI (US)

(72) Inventors: JiaXin Fan, Jiangsu (CN); Roger Ovenden, Orange (AU); James Sealey, Hunterview (AU); Ke Wen, Shanghai (CN)

(73) Assignee: ODL, Incorporated, Zeeland, MI (US)

( * ) Notice: Subject to any disclaimer, the term of this patent is extended or adjusted under 35 U.S.C. 154(b) by 168 days.

(21) Appl. No.: 15/540,465

(22) PCT Filed: Jan. 15, 2016

(86) PCT No.: PCT/US2016/013561
§ 371 (c)(1),
(2) Date: Jun. 28, 2017

(87) PCT Pub. No.: WO2016/115440
PCT Pub. Date: Jul. 21, 2016

(65) Prior Publication Data

US 2018/0010385 A1 Jan. 11, 2018

Related U.S. Application Data

(60) Provisional application No. 62/103,964, filed on Jan. 15, 2015.

(51) Int. Cl.
*E06B 9/264* (2006.01)
*E06B 9/24* (2006.01)
*E06B 9/322* (2006.01)

(52) U.S. Cl.
CPC ..... *E06B 9/264* (2013.01); *E06B 9/24* (2013.01); *E06B 9/322* (2013.01);
(Continued)

(58) Field of Classification Search
CPC .. E06B 9/264; E06B 9/322; E06B 2009/2643; E06B 9/24; E06B 2009/2646;
(Continued)

(56) References Cited

U.S. PATENT DOCUMENTS 85,818 A * 1/1869 Harding ..... E06B 3/485
160/113
2,749,581 A * 6/1956 McCormick ..... E06B 7/084
49/90.1

(Continued)

OTHER PUBLICATIONS

PCT International Search Report and Written Opinion prepared for PCT/US2016/013561, dated Apr. 11, 2016, 10 pages.

*Primary Examiner* — Daniel P Cahn
(74) *Attorney, Agent, or Firm* — Barnes & Thornburg LLP

(57) ABSTRACT

A panel unit includes an interconnected first and second pair of juxtaposed panels, a spacer joining together opposing inner faces of the pairs of panels about a periphery of the interconnected pair to define common air space therebetween, first and second blind assemblies positioned in the air space between the first and second pair of panels respectively, a first drive shaft coupled to a first set of louvers of the first blind assembly and a second drive shaft coupled to a second set of louvers of the second blind assembly, an actuator connected to the first drive shaft, and an interface structure rotationally fixing together opposing ends the first and second drive shafts, wherein the first drive shaft is responsive to actuation of the actuator to axially rotate and thereby cause simultaneous rotation of the first and second sets of louvers between the open and closed positions thereof.

13 Claims, 9 Drawing Sheets

(52) U.S. Cl.
CPC ..... *E06B 2009/2435* (2013.01); *E06B 2009/2458* (2013.01); *E06B 2009/2643* (2013.01); *E06B 2009/2646* (2013.01)

(58) Field of Classification Search
CPC ..... E06B 2009/2435; E06B 2009/2458; E06B 2009/2447
See application file for complete search history.

(56) References Cited

U.S. PATENT DOCUMENTS 2,957,520 A * 10/1960 Howard ..... E06B 9/302 160/113
2,979,127 A * 4/1961 Brown ..... E06B 9/306 160/115
3,298,424 A * 1/1967 Griffin ..... E06B 3/921 160/113
5,226,466 A * 7/1993 Coddens ..... E06B 9/264 160/107
6,123,137 A * 9/2000 Levert ..... E06B 9/264 160/107
6,571,851 B1 * 6/2003 Jelic ..... E06B 9/262 160/107
9,416,583 B2 * 8/2016 Briese ..... E06B 3/67326
2004/0168778 A1 9/2004 Smith
2006/0076113 A1 * 4/2006 Park ..... E06B 9/264 160/107
2006/0118250 A1 6/2006 Jin et al.
2008/0250733 A1 * 10/2008 Konstantin ..... A01G 9/22 52/173.3
2010/0132260 A1 * 6/2010 Lee ..... E06B 9/264 49/70
2012/0186754 A1 7/2012 Klem et al.
2014/0020851 A1 1/2014 Ouzts et al.
2018/0163461 A1 * 6/2018 Hall ..... E06B 9/264
2018/0171702 A1 * 6/2018 Hall ..... E06B 9/264
2018/0355658 A1 * 12/2018 Nicolosi ..... E06B 3/66309
2018/0355661 A1 * 12/2018 Hummel ..... E06B 9/264
2019/0003251 A1 * 1/2019 Amory ..... E06B 9/262

* cited by examiner

PANEL UNIT WITH MULTIPLE INTEGRATED AND COMMONLY ADJUSTABLE BLIND ASSEMBLIES

CROSS REFERENCE TO RELATED APPLICATIONS

This application is the U.S. national phase of PCT/US2016/013561 filed Jan. 15, 2016. PCT/US2016/013561 claims the benefit of and priority to U.S. provisional patent application Ser. No. 62/103,964 filed Jan. 15, 2015, the disclosure of which is expressly incorporated herein by reference.

FIELD OF THE INVENTION

The present invention relates generally to panel units, and more specifically to panel units having integrated blind assemblies.

BACKGROUND

Panel units are known in which a single blind assembly may be encased within an airspace defined between an opposing pair of panels. Panel units are also known which include multiple interconnected pairs of opposing panels.

SUMMARY

The present invention may comprise one or more of the features recited in the attached claims, and/or one or more of the following features and combinations thereof. In one aspect, a panel unit may comprise a first pair of multiple-edged, juxtaposed panels each defining opposing inner faces, a second pair of multiple-edged, juxtaposed panels each defining opposing inner faces, one of the multiple edges of the first pair of panels joined to one of the multiple edges of the second pair of panels to form an interconnected pair of panels, a spacer joining together the opposing inner faces of the first and second pair of panels about a periphery of the interconnected pair of panels to define common air space between the first pair of panels and the second pair of panels, a first blind assembly positioned in the air space between the first pair of panels, the first blind assembly having a first head rail mounted in the air space near a top edge of the first pair of panels, a first drive shaft carried by the first head rail, and a first set of louvers extending downwardly from the first head rail and coupled to the first drive shaft, the first set of louvers responsive to axial rotation of the first drive shaft to rotate between open and closed positions, a second blind assembly positioned in the air space between the second pair of panels, the second blind assembly having a second head rail mounted in the air space near a top edge of the second pair of panels, a second drive shaft carried by the second head rail, and a second set of louvers extending downwardly from the second head rail, the second set of louvers responsive to axial rotation of the second drive shaft to rotate between open and closed positions, a first actuator connected to the first drive shaft, the first drive shaft responsive to a first actuation of the first actuator to axially rotate, and an interface structure rotationally fixing one end of the first drive shaft to one end of the second drive shaft adjacent to the joined edges of the first and second pair of panels to cause the first and second drive shafts to rotate together, wherein the first actuation of the first actuator causes simultaneous rotation of the first and second sets of louvers between the open and closed positions thereof.

One of the first pair of panels may define a first planar face and a corresponding one of the second pair of panels may define a second planar face, wherein the first and second planar faces define an angle therebetween. In one example embodiment, the angle may be approximately 90 degrees. In another example embodiment, the angle may be any acute angle. In yet another example embodiment, the angle may be any obtuse angle. In a further example embodiment, the angle may be approximately 180 degrees.

In some embodiments, each of the first and second pair of panels may be glass.

In some embodiments, the first actuator may be further coupled to each of the first and second sets of louvers, the first and second sets of louvers simultaneously responsive to a second actuation of the first actuator to raise and lower relative to the first and second head rails respectively.

One of more of the foregoing embodiments may further comprise a first side rail positioned between the first pair of panels along an outer edge thereof, wherein the first actuator is coupled to the first side rail and to an opposite end of the first drive shaft adjacent to the outer edge of the first pair of panels.

One or more of the foregoing embodiments may further comprise a second actuator connected to the second drive shaft, the second drive shaft responsive to a first actuation of the second actuator to axially rotate, wherein the first actuation of the second actuator causes simultaneous rotation of the first and second sets of louvers between the open and closed positions thereof. The second actuator may be further coupled to each of the first and second sets of louvers, the first and second sets of louvers simultaneously responsive to a second actuation of the second actuator to raise and lower relative to the first and second head rails respectively. Some such embodiments may further comprise a first side rail positioned between the first pair of panels along an outer edge thereof, the first actuator coupled to the first side rail and to an opposite end of the first drive shaft adjacent to the outer edge of the first pair of panels, and a second side rail positioned between the second pair of panels along an outer edge thereof, the second actuator coupled to the second side rail and to an opposite end of the second drive shaft adjacent to the outer edge of the second pair of panels.

In another aspect, a panel unit may comprise a first pair of multiple-edged, juxtaposed panels each defining opposing inner faces, a second pair of multiple-edged, juxtaposed panels each defining opposing inner faces, one of the multiple edges of the first pair of panels joined to one of the multiple edges of the second pair of panels to form an interconnected pair of panels, a spacer joining together the opposing inner faces of the first and second pair of panels about a periphery of the interconnected pair of panels to define common air space between the first pair of panels and the second pair of panels, a first blind assembly positioned in the air space between the first pair of panels, the first blind assembly having a first head rail mounted in the air space near a top edge of the first pair of panels, a first drive shaft carried by the first head rail, and a first set of louvers extending downwardly from the first head rail and coupled to the first drive shaft, the first set of louvers responsive to axial rotation of the first drive shaft to raise and lower relative to the first head rail, a second blind assembly positioned in the air space between the second pair of panels, the second blind assembly having a second head rail mounted in the air space near a top edge of the second pair of panels, a second drive shaft carried by the second head rail, and a second set of louvers extending downwardly from the second head rail, the second set of louvers responsive to axial rotation of the second drive shaft to raise and lower relative to the second head rail, a first actuator connected to the first drive shaft, the first drive shaft responsive to a first actuation of the first actuator to axially rotate, and an interface structure rotationally fixing one end of the first drive shaft to one end of the second drive shaft adjacent to the joined edges of the first and second pair of panels to cause the first and second drive shafts to rotate together, wherein the first actuation of the first actuator causes simultaneous raising or lowering of the first and second sets of louvers.

In yet another aspect, a panel unit may comprise a first pair of multiple-edged, juxtaposed panels each defining opposing inner faces, one of the first pair of panels defining a first planar face, a second pair of multiple-edged, juxtaposed panels each defining opposing inner faces, one of the second pair of panels defining a second planar surface, one of the multiple edges of the first pair of panels joined to one of the multiple edges of the second pair of panels to form an interconnected pair of panels with the first planar face adjacent to the second planar face and defining an angle therebetween, a first blind assembly positioned between the first pair of panels, the first blind assembly having a first head rail mounted near a top edge of the first pair of panels and a first set of louvers extending downwardly from the first head rail, a second blind assembly positioned between the second pair of panels, the second blind assembly having a second head rail mounted near a top edge of the second pair of panels and a second set of louvers extending downwardly from the second head rail, a first side rail positioned between the first pair of panels along an outer edge thereof, a first actuator operatively engaging the first side rail and operatively coupled to each of the first and second blind assemblies, the first actuator responsive to actuation to control at least one of simultaneously opening or closing the first and second sets of louvers and simultaneously raising or lowering the first and second sets of louvers, a second side rail positioned between the second pair of panels along an outer edge thereof, and a second actuator operatively engaging the second side rail and operatively coupled to each of the first and second blind assemblies, the second actuator responsive to actuation to control at least one of simultaneously opening or closing the first and second sets of louvers and simultaneously raising or lowering the first and second sets of louvers.

BRIEF DESCRIPTION OF THE DRAWINGS

This disclosure is illustrated by way of example and not by way of limitation in the accompanying figures. Where considered appropriate, reference labels have been repeated among the figures to indicate corresponding or analogous elements.

DETAILED DESCRIPTION OF THE DRAWINGS

Figure 1A:
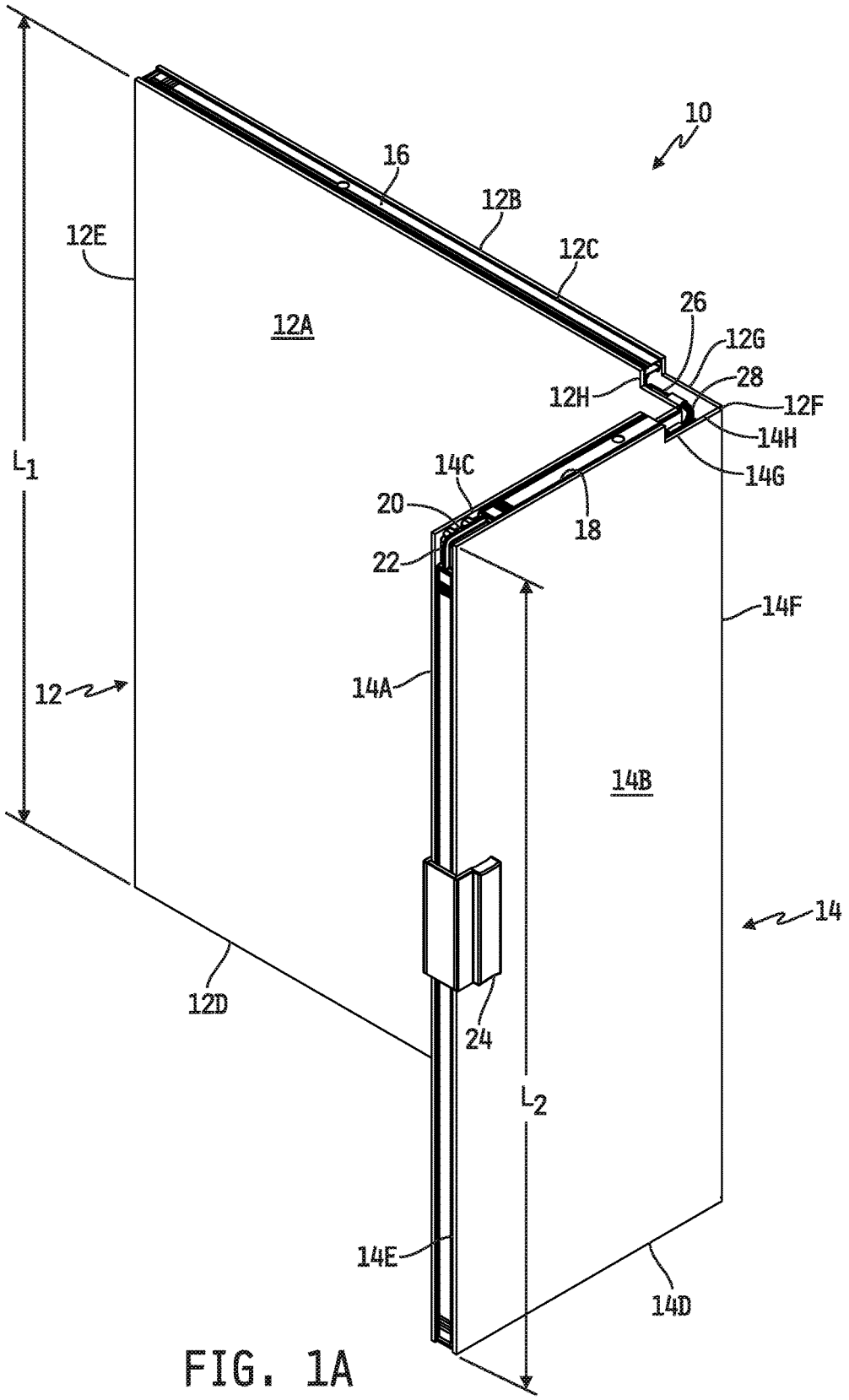
FIG. 1A is a simplified block diagram of an embodiment of a panel unit having two interconnected pairs of opposing panels encasing two corresponding interconnected blind assemblies.
Figure 1B:
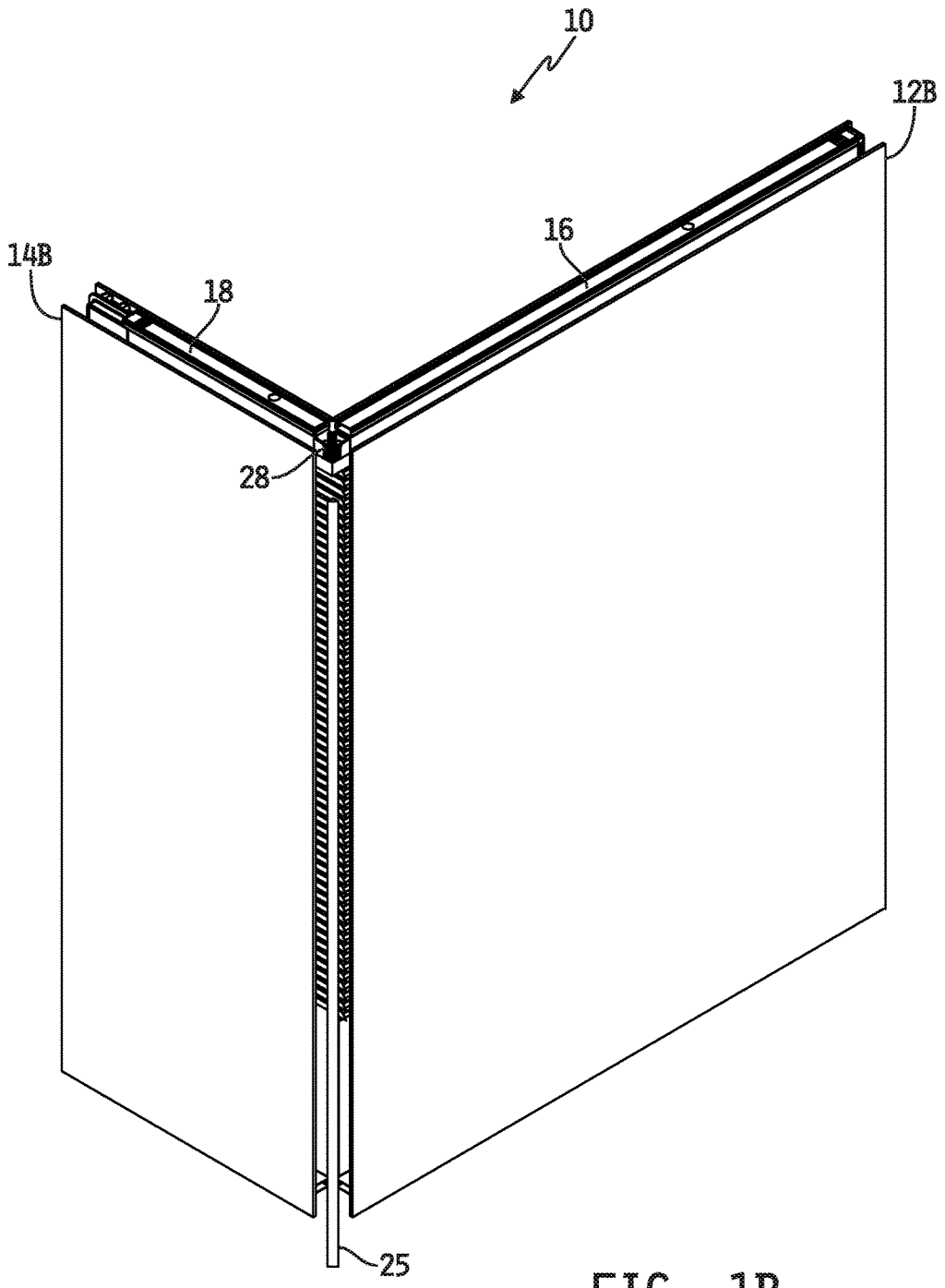
FIG. 1B is a partial exploded view of the panel unit of FIG. 1A showing the outer panels 12B and 14B separated from the remaining components of the unit.
Figure 2:
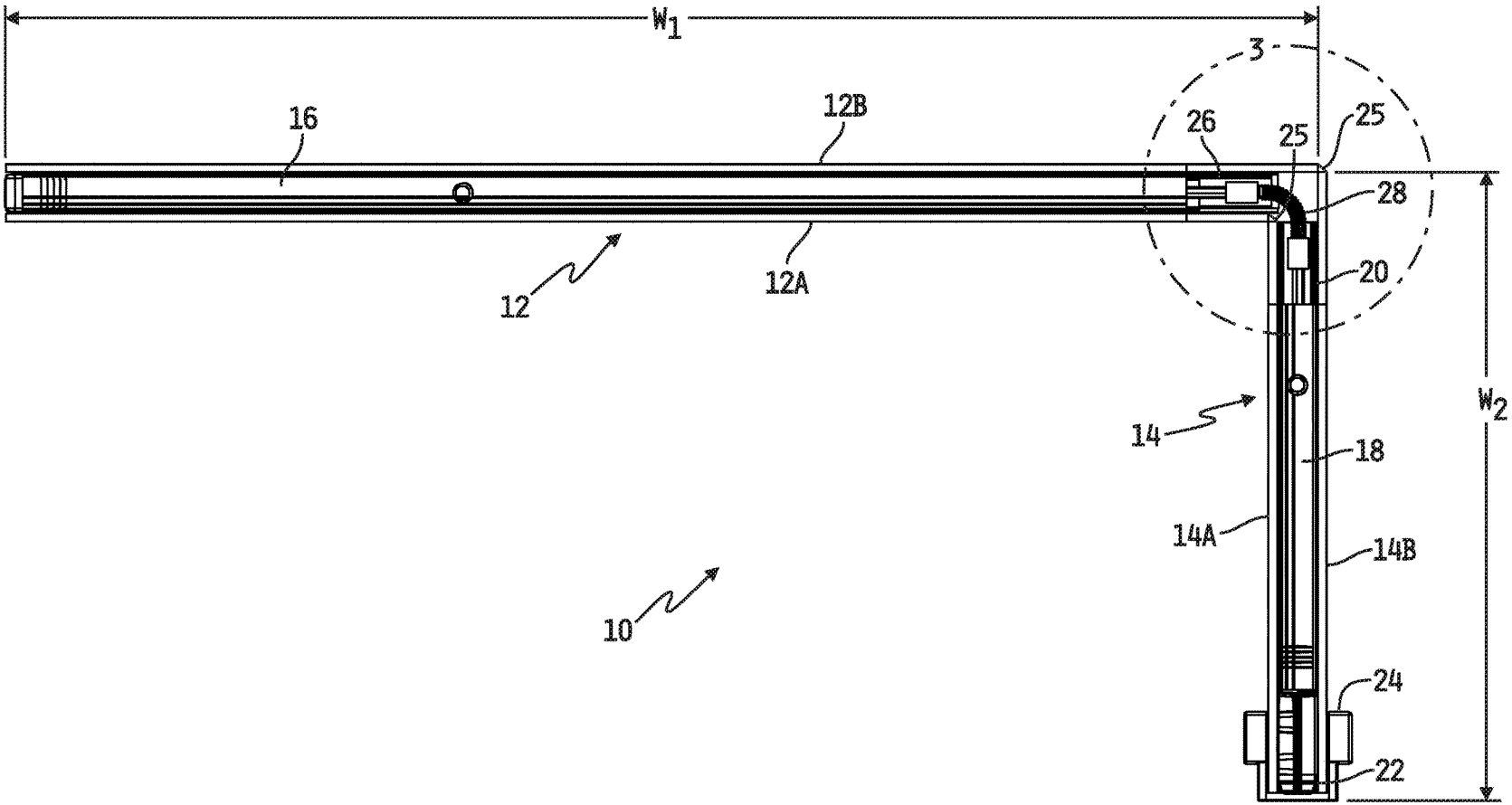
FIG. 2 is a top plan view of the embodiment illustrated in FIG. 1.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases may or may not necessarily refer to the same embodiment. Further, when a particular feature, structure, process, process step or characteristic is described in connection with an embodiment, it is submitted that it is within the knowledge of one skilled in the art to effect such feature, structure, process, process step or characteristic in connection with other embodiments whether or not explicitly described. Further still, it is contemplated that any single feature, structure, process, process step or characteristic disclosed herein may be combined with any one or more other disclosed feature, structure, process, process step or characteristic, whether or not explicitly described, and that no limitations on the types and/or number of such combinations should therefore be inferred.

This disclosure is directed to integrating, i.e., encasing, multiple blind assemblies within panel units that have multiple interconnected pairs of opposing panels such that the multiple blind assemblies are commonly adjustable, i.e., via single actuator or set of actuators, in raising and lowering (or drawing left and right) the multiple sets of blinds and/or in tilting or rotating louvers carried by each of the multiple sets of blinds. Referring now to FIGS. 1-4, an embodiment is shown of one such panel unit 10 which includes two interconnected pairs 12, 14 of opposing panels positioned at an angle "A" relative to planes defined by common-sided panels 12A, 14A of each pair of interconnected panels 12, 14. In the illustrated embodiment, the angle "A" is approximately 90 degrees, although this disclosure contemplates alternate angles greater or less than 90 degrees, e.g., any angle within the range 0 degrees≤A≤360 degrees.

In the embodiment illustrated in FIGS. 1-4, the panel unit 10 includes a first pair of opposing, juxtaposed panels 12A and 12B separated by a spacer 16. The panels 12A and 12B are each planar panels, with the panel 12A defining an inner planar surface that opposes an inner planar surface of the other panel 12B, and with each panel 12A, 12B defining an outer planar surface opposite its respective inner planar surface. Each panel 12A, 12B is illustratively rectangular in shape and has a top edge 12C, a bottom edge 12D opposite the top edge 12C, and outer side edge 12E and an inner side edge 12F opposite the outer side edge. Adjacent to the inner side edge 12F, the top edge 12C of each panel 12A, 12B further illustratively defines a stepped-down region or section 12G which extends from the inner side edge 12F toward the outer side edge 12E and terminates at a step 12H. In the illustrated embodiment, with the exception of the inner side edges 12F, all such edges 12C, 12D, 12E, 12G and 12H of the panel 12A are coterminous with the corresponding edges 12C, 12D, 12E, 12G and 12H of the panel 12B, such that the juxtaposed panels 12A, 12B generally define a width, $W_1$, and a length, $L_1$. As most clearly illustrated in FIGS. 3A and 3B, the inner side edge 12F of the panel 12B extends beyond the inner side edge 12F of the panel 12A. It will be understood, in any case, that this disclosure contemplates embodiments in which any edge 12C-12H of one panel 12A, 12B may extend beyond a corresponding edge 12C-12H of the other panel 12A, 12B.

The illustrated panel unit 10 further illustratively includes a second pair of opposing, juxtaposed panels 14A and 14B separated by a spacer 18. The panels 14A and 14B are each planar panels, with the panel 14A defining an inner planar surface that opposes an inner planar surface of the other panel 14B, and with each panel 14A, 14B defining an outer planar surface opposite its respective inner planar surface. Each panel 14A, 14B is illustratively rectangular in shape and has a top edge 14C, a bottom edge 14D opposite the top edge 14C, and outer side edge 14E and an inner side edge 14F opposite the outer side edge. Adjacent to the inner side edge 14F, the top edge 14C of each panel 14A, 14B further illustratively defines a stepped-down region or section 14G which extends from the inner side edge 14F toward the outer side edge 14E and terminates at a step 14H. In the illustrated embodiment, with the exception of the inner side edges 14F, all such edges 14C, 14D, 14E, 14G and 14H of the panel 14A are coterminous with the corresponding edges 14C, 14D, 14E, 14G and 14H of the panel 14B, such that the juxtaposed panels 14A, 14B generally define a width, $W_2$, and a length, $L_2$. As most clearly illustrated in FIGS. 3A and 3B, the inner side edge 14F of the panel 14B extends beyond the inner side edge 14F of the panel 14A. It will be understood, in any case, that this disclosure contemplates embodiments in which any edge 14C-14H of one panel 14A, 14B may extend beyond a corresponding edge 14C-14H of the other panel 14A, 14B In the embodiment illustrated in FIGS. 1-4, the width, $W_1$, of the panels 12A, 12B is greater than the width, $W_2$, of the panels 14A, 14B, whereas the lengths $L_1$ and $L_2$ are substantially equal. It will be understood, however, that while the width, $W_1$, of the panels 12A, 12B is illustrated in FIGS. 1-4 as being greater than the width, $W_2$, of the panels 14A, 14B, in alternate embodiments the width $W_1$ may be less than or equal to the width $W_2$. Similarly, while the length, $L_1$, of the panels 12A, 12B is illustrated in FIGS. 1-4 as being substantially equal to the length, $L_2$, of the panels 14A, 14B, in alternate embodiments the lengths $L_1$ and $L_2$ may be different. It will be further understood that while the panels 12A, 12B and 14A, 14B are illustrated in FIGS. 1-4 as being generally rectangular in shape, this disclosure contemplates alternate embodiments in which the panels 12A, 1B and/or the panels 14A, 14B may have non-rectangular shapes. Also in the embodiment illustrated in FIGS. 1-4, the width, $W_1$, of the panels 12A, 12B is less than the length, $L_1$, of the panels 12A, 12B, and the width, $W_2$, of the panels 14A, 14B is less than the length, $L_2$, of the panels 14A, 14B, although it will be understood that in alternate embodiments $W_1$ may be equal to or greater than $L_1$ and/or $W_2$ may be equal to or greater than $L_2$.

Figure 7:
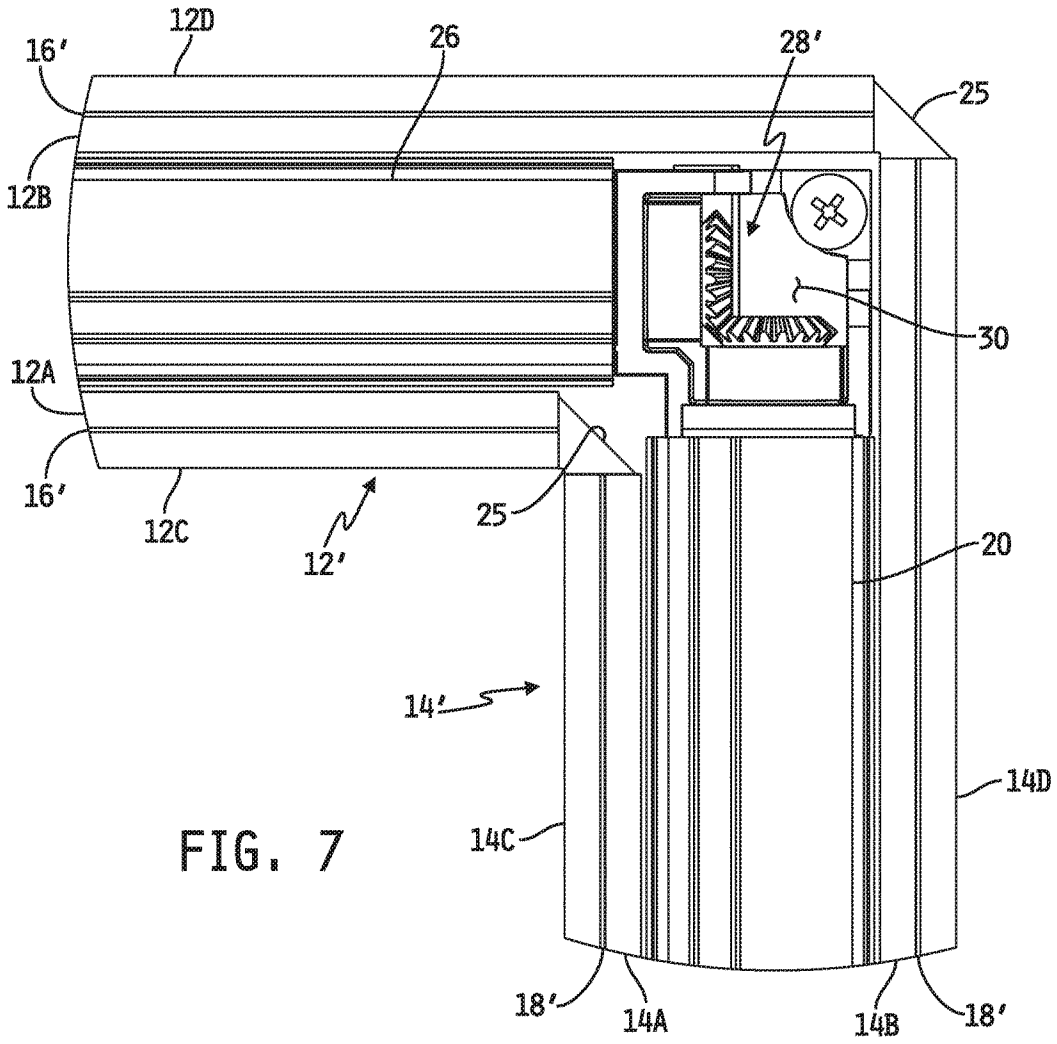
FIG. 7 is a magnified view similar to FIG. 3B illustrating still another embodiment of a panel unit having multiple panels on each side of the unit.

In some embodiments, each panel 12A, 12B, 14A, 14B is illustratively made of glass. In some alternate embodiments, one or more of the panels 12A, 12B, 14A, 14B may be or include one or more alternate materials, examples of which include, but are not limited to, optically transparent or translucent polycarbonate, poly(methyl methacrylate), also known as PMMA or acrylic, or the like. In any such embodiment, one or more of the panels 12A, 12B, 14A, 14B may be or include multiple materials and/or may be or include one or more areas of transparency, one or more areas of translucence, one or more areas of opaqueness and/or one or more non-light transmissive areas. Each panel 12A, 12B, 14A, 14B is further illustrated in FIGS. 1-4 as including a single panel, although it will be understood that in alternate embodiments any such panel 12A, 12B, 14A, 14B may be or include two or more juxtaposed panels defining an air space therebetween and/or joined by one or more films, adhesives or the like, an example of which is illustrated in FIG. 7. In some embodiments, one or more of the panels 12A, 12B, 14A, 14B may have one or more coatings or films applied to either or both of the inner and outer planar surfaces thereof. Alternatively or additionally, one or more films and/or other structures may be positioned between the juxtaposed panels 12A, 12B and/or the juxtaposed panels 14A, 14B.

Illustratively, the spacer 16 is positioned between and adhered to the inner surfaces of each of the panels 12A, 12B, and extends along and adjacent to the top edge 12C, the outer side edge 12E and the bottom edge 12D. Illustratively, the spacer 16 extends along the top edge 12C to the step 12H where it terminates coincident with the step 12H. The spacer 18 likewise is illustratively positioned between and adhered to the inner surfaces of each of the panels 14A, 14B, and extends along and adjacent to the top edge 14C, the outer side edge 14E, and the bottom edge 14D, and terminates coincident with the step 14H at the top edge 14C. The spacers 16 and 18 illustratively extend along the bottom edges 12D, 14D respectively and terminate at the inner side edges 12F, 14F respectively. In some embodiments, the spacers 16, 18 may not contact each other at the inner side edges 12F, 14F along the top edges 12C, 14C thereof, as illustrated in FIGS. 1-4, while in some alternate embodiments the spacers 16, 18 may contact each other, and/or be connected together, at the inner side edges 12F, 14F along the top edges 12C, 14C thereof. Likewise, the spacers 16, 18 may or may not contact each other, and/or be connected together, at the inner side edges 12F, 14F along the bottom edges 12D, 14D. In some alternate embodiments, the spacer 16 may extend partially along the inner side edge 12F from the top edge 12C and/or from the bottom edge 12D thereof, and/or the spacer 18 may extend partially along the inner side edge 14F from the top edge 14C and/or from the bottom edge 14D thereof. In such embodiments, however, neither spacer 16, 18 extends completely or entirely along the inner side edge 12F, 14F respectively. In any case, the spacers 16 and 18 together define an airspace 30 between the panels 12A, 12B and the panels 14A, 14B, which airspace 30 is, in the illustrated embodiment, bounded by the spacers 16, 18 along the top edges 12C, 14C, the outer side edges 12E, 14E and the bottom edges 12D, 14D of the respective pairs of panels 12A, 12B and 14A, 14B. The airspace 30 is thus illustratively common to, open to and shared by each of the two sets of opposing panels 12A, 12B and 14A, 14B.

Figure 3A:
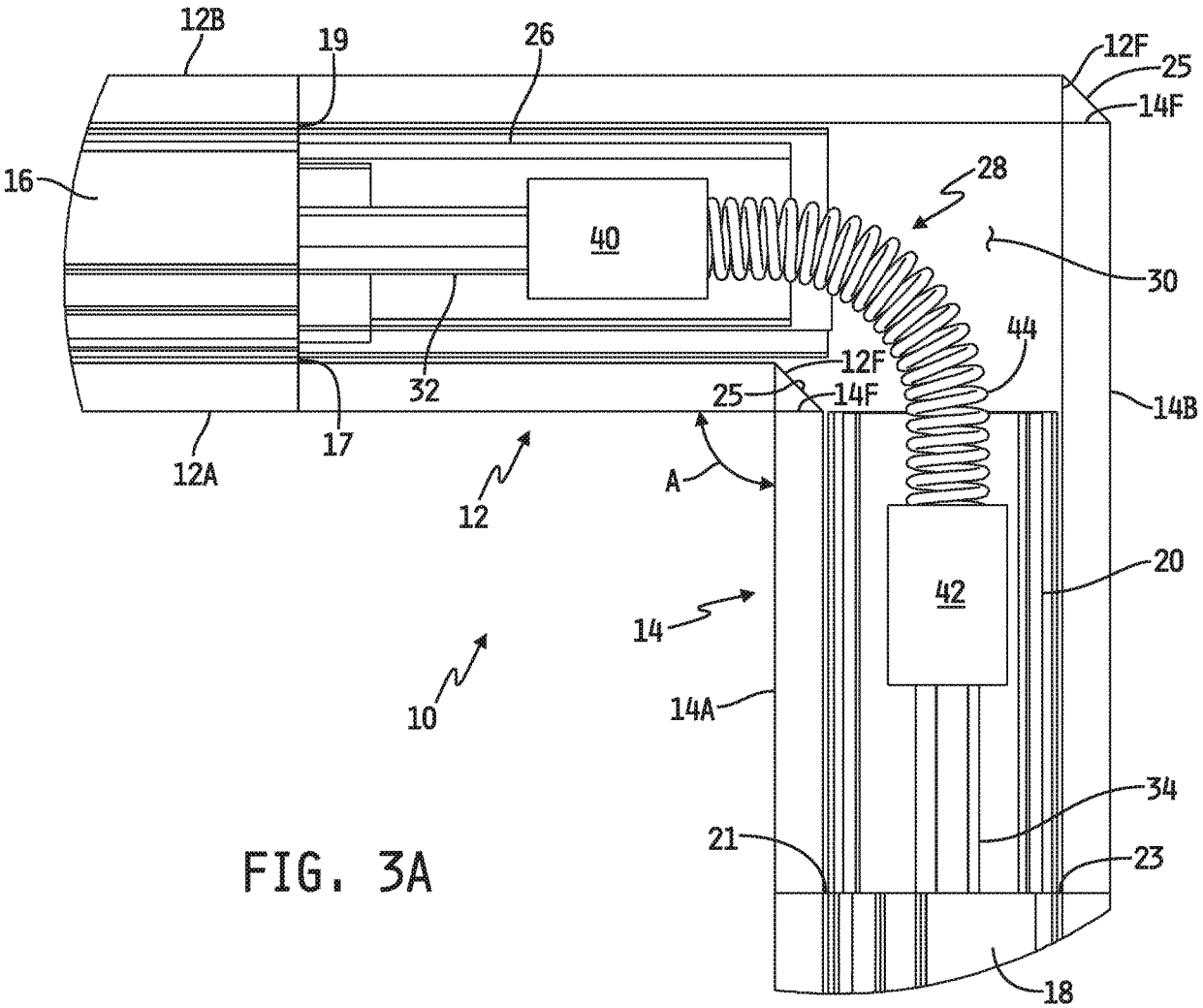
FIG. 3A is a magnified view of a portion of the embodiment illustrated in FIG. 2 showing an embodiment of an interface structure interconnecting the two blind assemblies.

As illustrated by example in FIG. 3A, the spacers 16, 18 may be affixed to the panels 12A, 12B and 14A, 14B respectively via an adhesive or other bonding medium positioned between the spacers 16, 18 and each of the panels 12A, 12B and 14A, 14B respectively. In the illustrated embodiment, for example, a layer 17 of adhesive or other bonding material is positioned between, and in contact with, one side or edge of the spacer 16 and the inner surface of the panel 12A, and a layer 19 of adhesive or other bonding material is positioned between, and in contact with, an opposite side or edge of the spacer 16 and the inner surface of the panel 12B. The bonding layers 17, 19 serve to bond the panels 12A, 12B to the spacer 16 to form an air-tight seal therebetween. Similarly, a layer 21 of adhesive or other bonding material is positioned between, and in contact with, one side or edge of the spacer 18 and the inner surface of the panel 14A, and a layer 23 of adhesive or other bonding material is positioned between, and in contact with, an opposite side or edge of the spacer 18 and the inner surface of the panel 14B. The bonding layers 21, 23 likewise serve to bond the panels 14A, 14B to the spacer 18 to form an air-tight seal therebetween. It will be appreciated that other conventional techniques may alternatively be used to join the spacers 16, 18 to the panels 12A, 12B and 14A, 14B respectively such as back-bedding a bonding medium between the spacer and inner surfaces of the panels, or the like.

The two pairs of panels 12, 14 are illustratively interconnected along their inner side edges 12F, 14F such that the airspace 30 is common to both sets of panels 12, 14 as described above. In some embodiments, the panels 12, 14 are attached together along their entire lengths, and in other alternative embodiments only partially along their lengths. In the simplified diagram 3A, the inner side edge 12F of the panel 12A is shown attached to the inner side edge 14F of the panel 14A, and the inner side edge 12F of the panel 12B is shown attached to the inner side edge 14F of the panel 14B, both via an adhesive or other bonding material 25. In the embodiment illustrated in FIG. 1B, for example, the adhesive or bonding material 25 illustratively extends between the panels 12A, 14A and 12B, 14B along the entire lengths of the panels. In other embodiments, the inner side edge 12F of the panel 12A may alternatively abut the outer planar surface of the panel 14A, and in still other embodiments the inner side edge 14F of the panel 14A may alternatively abut the outer planar surface of the panel 12A. In some alternative embodiments, the inner side edge 12F of the panel 12B may alternatively abut the inner planar surface of the panel 14B, and in other alternative embodiments the inner side edge 14F of the panel 14B may alternatively abut the inner planar surface of the panel 12B. In some embodiments, the panels 12A, 14A and 12B, 14B may be attached together via one or more conventional adhesives and/or other bonding materials, e.g., adhesive or other bonding material 25 as illustrated in FIGS. 1B-3B, 5B, 6B and 7, and other embodiments may include one or more additional structures to facilitate and/or enhance attachment between the panel 12A and the panel 14A, and/or to facilitate and/or enhance attachment between the panel 12B and the panel 14B. In some embodiments, the interface between the inner side edges of the panels 12A, 14A and/or the interface between the inner side edges of the panels 12B, 14B may be sealed entirely or partially along the lengths of the panels 12, 14 with a conventional moisture and/or air-impervious sealant.

Figure 4:
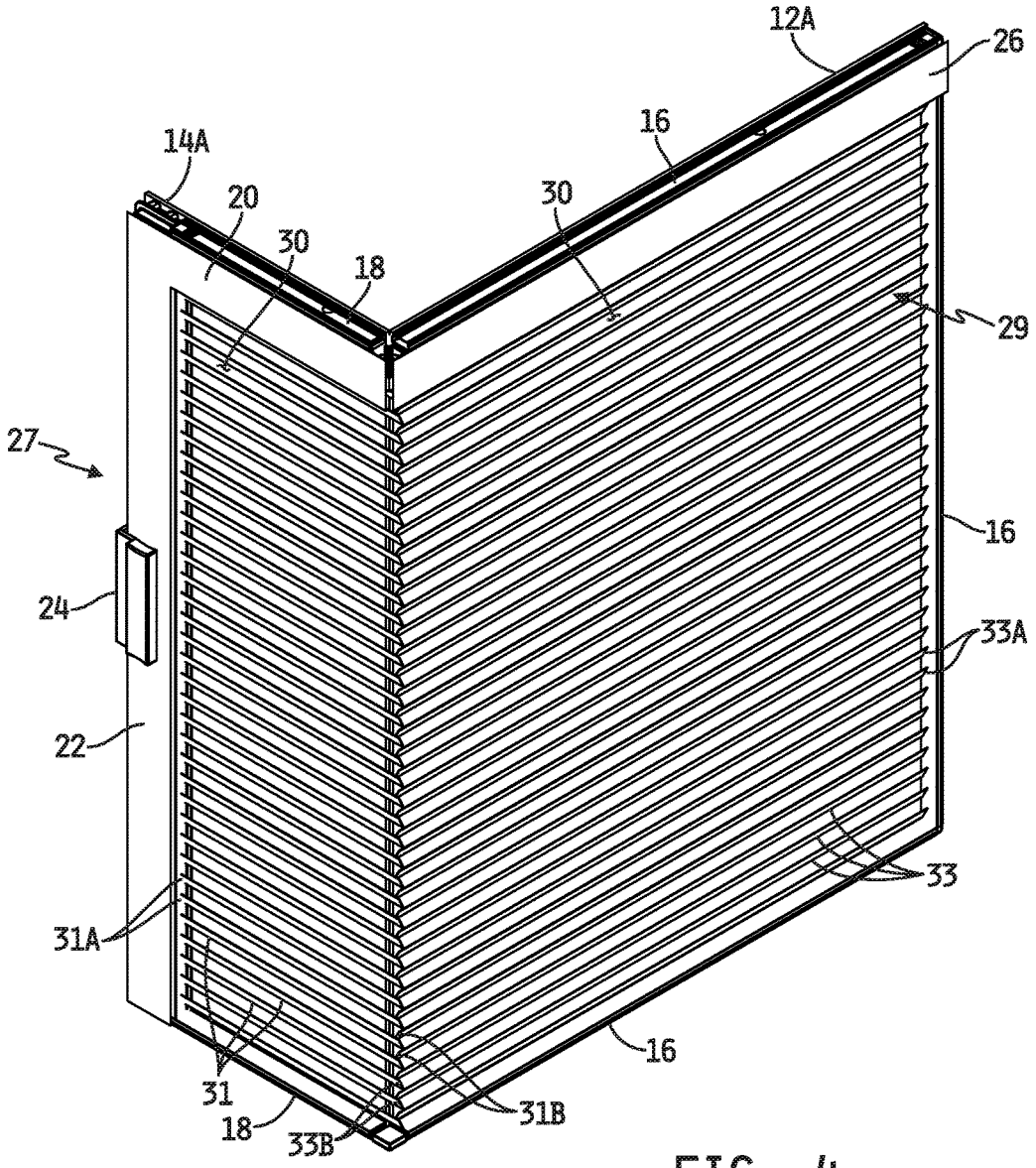
FIG. 4 is a simplified block diagram similar to FIG. 1 showing the blind assemblies encased within the two interconnected pairs of opposing panels of the illustrated insulating glass unit.

As most clearly illustrated in FIG. 4, a blind assembly 27 is mounted within the airspace 30 defined between the opposing panels 14A, 14B of the pair or set of panels 14, and another separate blind assembly 29 is mounted within the airspace 30 defined between the opposing panels 12A, 12B of the pair or set of panels 12. It will be understood that in FIG. 4 the panels 12B and 14B have been omitted so as not to obscure the underlying structures. Illustratively, the blind assembly 27 includes an elongated head rail 20, and in one embodiment the head rail 20 is mounted to or carried by the spacer 18 along the top edge 14C of the pair or set of panels 14A, 14B. In other embodiments, the elongated head rail 20 is mounted between the panels 14A, 14B, but not to or carried by the spacer 18. In any case, the elongated head rail 20 is mounted within the portion of the air space 30 defined between the panels 14A, 14B, and a set of interconnected louvers 31 is mounted to the head rail 20 and extends downwardly therefrom within the air space 30. Likewise, the blind assembly 29 includes an elongated head rail 26 that is illustratively mounted to or carried by the spacer 16 along the top edge 12C of the pair or set of panels 12A, 12B, and a set of interconnected louvers 33 is mounted to the head rail 26 and extends downwardly therefrom. In other embodiments, the elongated head rail 26 is mounted between the panels 12A, 12B, but not to or carried by the spacer 16. In any case, the elongated head rail 20 is mounted within the portion of the air space 30 defined between the panels 12A, 12B.

The blind assembly 27 further illustratively includes an elongated side rail 22 positioned between the panels 14A and 14B and extending at least partially along and adjacent to the outer edges 14E of the panels 14A, 14B. In some embodiments, one end of the side rail 22 is mounted to one end of the head rail 20, and the side rail 22 extends downwardly from the one end to an opposite end thereof. In alternate embodiments, the side rail 22 may be mounted such that one end is positioned adjacent to or proximate to, but not connected to, the head rail 20. In some embodiments, the side rail 22 is attached, connected or affixed to the spacer 18 along the outer edges 14E of the panels 14A, 14B, and in other embodiments the side rail 22 is not attached, connected, attached or affixed to the spacer 18. In any case, the opposite end of the side rail 22 extends downwardly toward the bottom edges 14D of the panels 14A, 14B. In the illustrated embodiment, the opposite end of the side rail 22 terminates at or adjacent to the bottom edges 14D of the panels 14A, 14B, although in other embodiments the opposite end of the side rail 22 may stop short of the bottom edges 14D, and in still other embodiments the opposite end of the side rail 22 may extend beyond the bottom edges 14D.

In the embodiment illustrated in FIG. 4, ends of the louvers 31 at one end 31A thereof extend into the side rail 22 where they are operatively connected to a blind assembly actuator 24, e.g., a slidable or otherwise actuatable handle 24. Opposite ends 31 B of the louvers 31 extend away from the ends 31A and terminate adjacent to the junction of the ends 12F, 14F of the outer panels 12B, 14B (see, e.g., FIGS. 3A and 3B). Ends of the louvers 33 at one end 33A thereof are adjacent to, or in some embodiments in contact with, the spacer 16, and opposite ends 33B of the louvers 33 illustratively terminate adjacent to, or in contact with, corresponding ends 31B of the louvers 31. In some embodiments, one or more flanges may extend along the spacer 16 adjacent to the ends 33A of the louvers, and in such embodiments the one or more flanges is/are illustratively configured to extend away from the spacer such that at least a portion of the louvers 33 adjacent the ends 33A are covered by the one or more flanges.

Figure 3B:
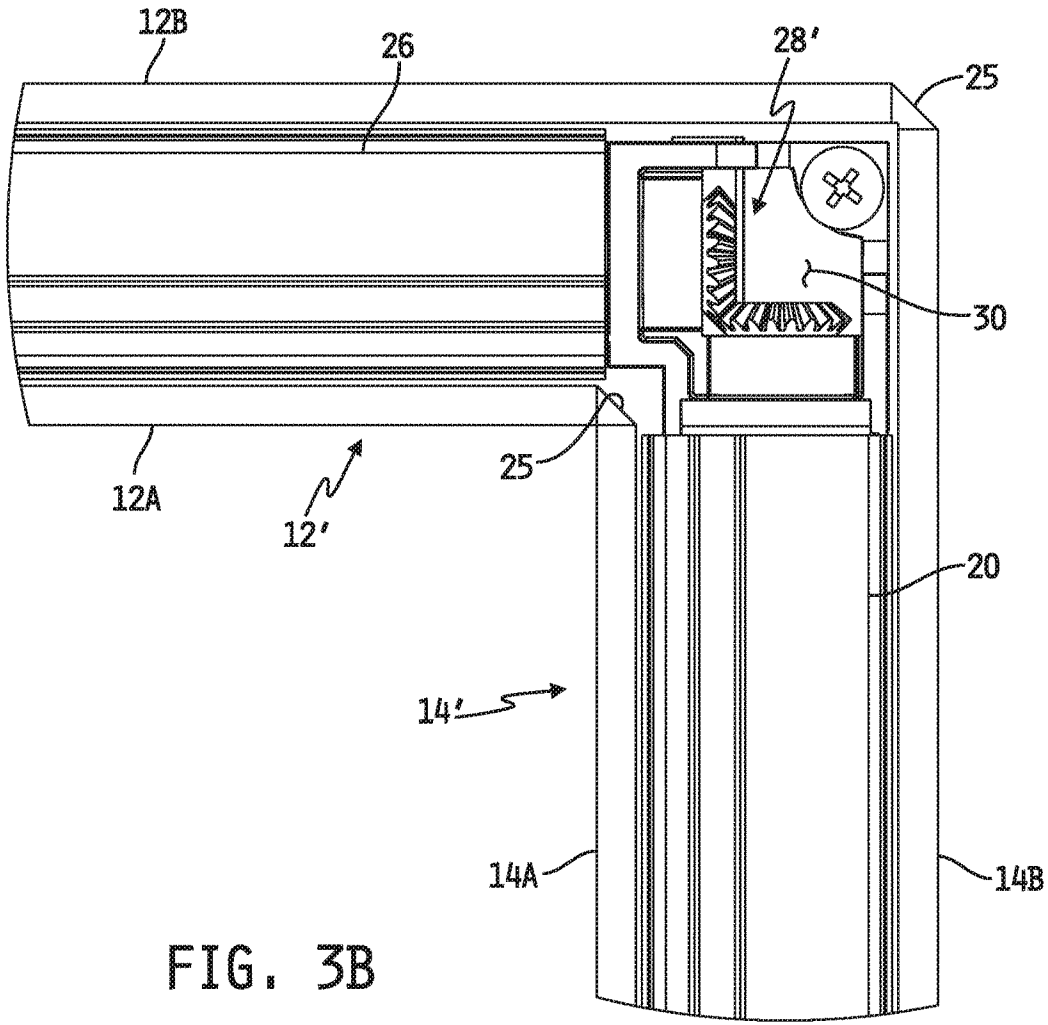
FIG. 3B is a magnified view similar to FIG. 3A illustrating an alternate embodiment of an interface structure for interconnecting the two blind assemblies.

As illustrated in FIGS. 3A and 3B, the blind assembly 27 further illustratively includes a rotatable drive shaft 34 that extends along the head rail 20 and is operatively coupled at one or more locations along its length, in a conventional manner, e.g., via one or more cords, cables or the like, to the set of interconnected louvers 31. One end of the drive shaft 34 extends toward the inner edges 14F of the panels 14A, 14B, and an opposite end extends toward the outer edges 14E of the panels 14A, 14B and operatively engages one or more conventional drive components carried by the side rail 22. A handle 24 is illustratively operatively carried by or otherwise engages the side rail 22, and the handle 24 is operatively coupled to opposite end of the drive shaft 34 via the one or more conventional drive components carried by the side rail 22. The one or more conventional drive components may illustratively be or include one or more movable mechanical structures, e.g., one or more cables, cords, pulleys, etc., and/or one or more conventional magnets, and in any case is/are driven by manual movement of the handle 24 relative to the side rail 22 to rotationally drive the drive shaft 34, i.e., to rotate the shaft 34, in a conventional manner.

The one or more conventional drive components is/are configured such that vertical movement of the handle 24 relative to the side rail 22 rotates the drive shaft 34 in a rotational direction defined by the direction of linear movement of the handle 24. Initial rotation of the drive shaft 34, resulting from a corresponding initial linear movement of the handle 24 relative to the side rail 22, illustratively causes each of the louvers in the interconnected set of louvers 31 to rotate to an open or closed position relative to the set of louvers 31, e.g., movement of the handle 24 linearly upwardly relative to the side 22 may cause the louvers 31 to rotate to an open position and movement of the handle 24 linearly downwardly relative to the side rail 22 may cause the louvers 31 to rotate to a closed position, or vice versa. In some embodiments, further rotation of the drive shaft 34 resulting from further and continued linear movement of the handle 24 relative to the side rail 22 illustratively causes one or more cords, cables or the like coupled between the drive shaft 34 and the interconnected set of louvers 31 to spool onto or from the drive shaft 34 to thereby raise or lower the set of interconnected louvers 23 respectively toward or away from the head rail 20.

In other embodiments, the handle 24 may be coupled directly to the interconnected set of louvers 31 via one or more cords, cables or the like, and in such embodiments the blind assembly 27 may further include a rotational stop or other mechanism operatively mounted to or adjacent to the drive shaft 34. In such embodiments, the drive shaft 34 illustratively rotates in response to initial linear movement of the handle 24 relative to the side rail 22 to open or close (e.g., "tilt") the interconnected set of louvers 31 as described above, the drive shaft 34 illustratively engages the rotational stop or other such mechanism as the set of louvers 31 reaches its fully open or closed position. When the drive shaft 34 engages the stop or other such mechanism, this blocks or disables further rotation of the drive shaft 34, and further and continued linear movement of the handle 24 relative to the side rail 22 raises or lowers the interconnected set of louvers via the direct coupling therebetween. Those skilled in the art will recognize other structures and/or mechanisms for controlling the raising/lowering of the set of louvers 31 and/or for rotating the set of louvers 31 between open and closed positions thereof, and it will be understood that any such other structures and/or mechanisms are contemplated by this disclosure.

The blind assembly 29 also further illustratively includes a rotatable drive shaft 32 that extends along the head rail 26 and is operatively coupled at one or more locations along its length, in a conventional manner, to the set of interconnected louvers 33. One end of the drive shaft 32 extends toward the inner edges 12F of the panels 12A, 12B and an opposite end extends toward the outer edges 12E of the panels 12A, 12B. In some embodiments, the one end of the drive shaft 32 terminates at or adjacent to the spacer 16 extending along the outer edges 12E of the panels 12A, 12B, and in other embodiments the one end of the drive shaft 32 stops short of the spacer 16 extending along the outer edges 12E. In still other alternate embodiments, the one end of the drive shaft 32 may extend beyond the spacer 16. In any case, the drive shaft 32 is rotationally driven as described with respect to the drive shaft 34 to open/close the interconnected set of louvers 33 and, in some embodiments, to also raise/lower the interconnected set of louvers 33. In embodiments in which the interconnected set of louvers 31 is raised/lowered via a direct cord or cable connection between the handle 24 and the interconnected set of louvers 31 as described above, the interconnected set of louvers 33 is illustratively coupled directly to the handle 24 via the same one or more cords or cables, e.g., via a common cord or set of cords. In alternate embodiments, the interconnected set of louvers 33 may be indirectly coupled to the handle 24, e.g., coupled through the panel(s) 14A and/or 14B via one or more magnets, or the like. In any such embodiments, and also in embodiments in which linear movement of the handle 24 relative to the side rail 22 rotationally drives the drive shaft 34 to raise/lower the interconnected set of louvers 31, the drive shaft 34 is illustratively rotationally coupled to the drive shaft 32 such that linear movement of the handle 24 relative to the side rail 22 simultaneously rotationally drives both the drive shaft 32 and the drive shaft 34. As such, the handle 24 is illustratively operatively coupled to both of the blind assemblies 27, 29 such that initial linear movement of the handle 24 relative to the side rail 22 results in simultaneous opening/closing of the interconnected set of louvers 31 and 33, and such that further and continued linear movement of the handle 24 relative to the side rail 22 results in simultaneous raising/lowering of the interconnected set of louvers 31 and 33. It will be understood that while movement of the handle 24 relative to the side rail 22 has been described herein as linear movement, this disclosure contemplates alternate embodiments in which the handle 24 and/or the side rail 22 is/are configured to provide for non-linear movement of the handle 24 relative to the side rail 22.

To provide for simultaneous rotational drive of the drive shafts 32, 34, the opposite ends of the drive shafts 32, 34, i.e., the ends that extend toward the inner edges 12F, 14F of the panels 12A, 12B and 14A, 14B respectively, are operatively coupled together by an interface structure 28. Illustratively, the interface structure 28 is designed to translate and transfer to the drive shaft 32 the rotational forces applied by actuation of the handle 24 to the end of the drive shaft 34 adjacent to the side rail 22 so that actuation of the handle 24 rotationally drives each of the drive shafts 32, 34. In some embodiments, the interface structure 28 is designed for a 1:1 translation and transfer of the rotational forces such that the drive shaft 32 rotates at the same rate and by the same amount as the drive shaft 34. In other embodiments, the interface structure 28 may be designed for a Y:Z translation and transfer of the rotational forces, where Y and Z are generally unequal and may each be any positive real number, such that the drive shafts 32, 34 rotates at any desired rate and amount relative to each other.

In the embodiment illustrated in FIG. 3A, the opposite ends of the drive shafts 32, 34, i.e., those that extend toward the inner edges 12F, 14F of the panels 12A, 12B and 14A, 14B respectively, are coupled together by an interface structure 28 illustratively provided in the form of a flexible, rotatable member affixed to the opposite ends of each drive shaft 32, 34. In the illustrated embodiment, the interface structure 28 illustratively includes a cap 40 defining a bore therein sized to receive and engage the opposite end of the drive shaft 32 in a rotationally fixed or locked manner, i.e., such that the cap 40 rotates with the drive shaft 32, and a cap 42 also defining a bore therein sized to receive and engage the opposite end of the drive shaft 34 in a rotationally fixed or locked manner, i.e., such that the cap 42 rotates with the drive shaft 34. In the embodiment illustrated in FIG. 3A, the drive shafts 32 and 34 each illustratively have a hexagonal cross-section, and in this embodiment the bore defined in the cap 40 and the bore defined by the cap 42 likewise each have a matingly configured hexagonal cross-section sized to receive and engage the ends of the respective drift shaft 32, 34 in a rotationally fixed or locked manner. It will be appreciated that the shafts 32, 34 and bores defined by the caps 40, 42 may have any desired cross-sectional shape that keys or otherwise causes the cap 40 to become rotationally fixed or locked to the shaft 32 and the cap 42 to become rotationally fixed or locked to the shaft 34. In other embodiments, the shafts 32, 34 and bores defined by the caps 40, 42 may have circular cross-sections, and the caps 40, 42 may be rotationally fixed to the respective shafts 32, 34 via suitable adhesive and/or one or more mechanical fixation members. In any case, the free or terminal ends of the caps 40, 42 are illustratively joined by an elongated, flexible member 44 configured to transfer rotational forces between the two caps 40, 42 to provide for simultaneous rotation of the drive shafts 32, 34 via actuation of the handle 24 as described above. In one embodiment, the flexible member 44 is provided in the form of an elongated, helical spring, although in other embodiments the flexible member 44 may be or include any bendable, flexible or otherwise formable member capable of connecting the two free ends of the caps 40, 42 disposed at the angle A relative to each other and transferring rotational forces therebetween.

In some embodiments, the panel unit 10 includes a single side rail 22 mounted between the panels 14A, 14B, e.g., adjacent to or coupled to the spacer 18 along the outer edges 14E of the panels 14A, 14B, and a single handle 24 operatively coupled thereto as illustrated in FIGS. 1-4 and operable as described above to simultaneously control both of the blind assemblies 27, 29. In other embodiments, the side rail 22 may be mounted between the panels 12A, 12B, e.g., adjacent to or coupled to the spacer 16 along the outer edges 12E of the panels 12A, 12B, and the handle 24, or other suitable handle, operable as described above, may be operatively coupled thereto. In still other embodiments, the panel unit 10 may include two sets of side rails 22 and handles 24; one side rail 22 mounted between the panels 14A, 14B as illustrated in FIGS. 1-4 and described above, with one handle 24 operatively coupled thereto, and another side rail 22 mounted between the panels 12A, 12B, e.g., adjacent to or coupled to the spacer 16 along the outer edges 12E of the panels 12A, 12B, with another handle 24 operatively coupled thereto. In such embodiments, the handle 24 mounted to the side rail 22 positioned between the panels 14A, 14B is operatively coupled to the drive shaft 34 as described above, and the handle 24 mounted to the side rail 22 between the panels 12A, 12B is operatively coupled to the drive shaft 32 in like manner. In this embodiment, either handle 24 may be actuated as described above to control operation, e.g., opening/closing and raising/lowering, of the two sets of interconnected louvers 31, 33. This feature is advantageous in embodiments in which two sets of panels 12A, 12B and 14A, 14B are separated by a wall, partition or other structure such that the pair of panels 12A, 12B is located in a room, hallway or space that is separate or separated from a room, hallway or space in which the pair of panels 14A, 14B is located.

Referring now to FIG. 3B, an alternate embodiment 10' of the panel unit is shown in which is illustratively identical to the embodiment 10 illustrated in FIGS. 1-3A and 4 except for an alternate embodiment of the interface structure 28'. In the embodiment illustrated in FIG. 3B, the interface structure 28' illustratively includes collar or disk 50 defining a bore therethrough sized to receive the drive shaft 32 therein, and a toothed gear 52 affixed to the free end of the drive shaft 32 such that the gear 52 rotates with the drive shaft 32. Likewise, the structure 28' further illustratively includes a collar or disk 54 defining a bore therethrough sized to receive the drive shaft 34 therein, and a toothed gear 56 affixed to the free end of the drive shaft 34 such that the gear 56 rotates with the drive shaft 34. In the illustrated embodiment, the collars 50, 54 are illustratively carried by, e.g., affixed to, a frame 58 positioned in the air space 30 at the interface between the panels 12A, 12B and 14A, 14B, and serve to align the teeth 52A of the gear 52 with the teeth 56A of the gear 56 so that they mesh. In some alternative embodiments, the collars 50 and 54 may be affixed to the drive shafts 32, 34 respectively such that the collar 50 rotates with the gear 52 and the collar 54 rotates with the gear 56. In any case, the teeth of the gear 52A of the gear 52 illustratively slope downwardly away from a flat end 52B thereof at an acute angle, and the teeth 56A of the gear 56 likewise illustratively slope downwardly away from a flat end 56B thereof at the same acute angle, and this acute angle is illustratively dictated by the angle, A, defined between the two sets of panels 12A, 12B and 14A, 14B. In the embodiment illustrated in FIG. 3B, the angle, A, is illustratively approximately 90 degrees, and those skilled in the art will recognize that in embodiments in which the angle, A, is other than 90 degrees, the angles defined by the slopes of the of the teeth 52A, 56A relative to the flat ends 52B, 56B will be adjusted to accommodate the angle A. In some alternative embodiments, the ends 52B, 56B of the gears 52, 56 respectively may not be flat but may be alternatively shaped to allow for the slopes of the teeth 52A, 56A to accommodate angles, A, other than 90 degrees. Examples of some such alternative shapes include, but are not limited to, conical, frustoconical, or other shape(s).

Figure 5A:
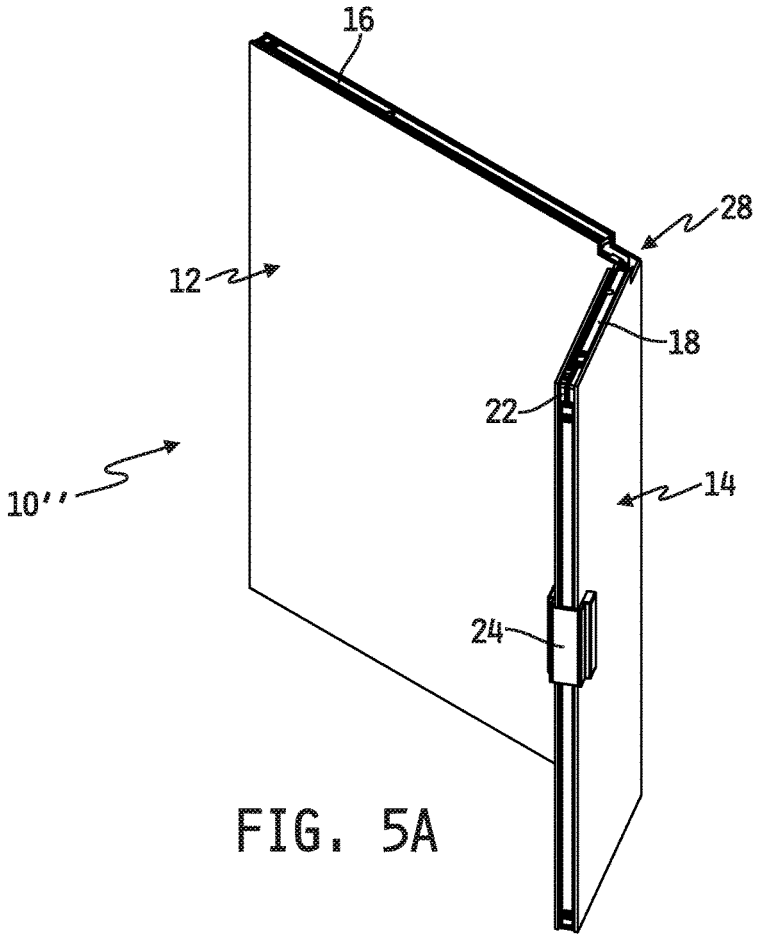
FIG. 5A is a simplified block diagram of another embodiment of panel unit having two interconnected pairs of opposing panels encasing two corresponding interconnected blind assemblies.
Figure 5B:
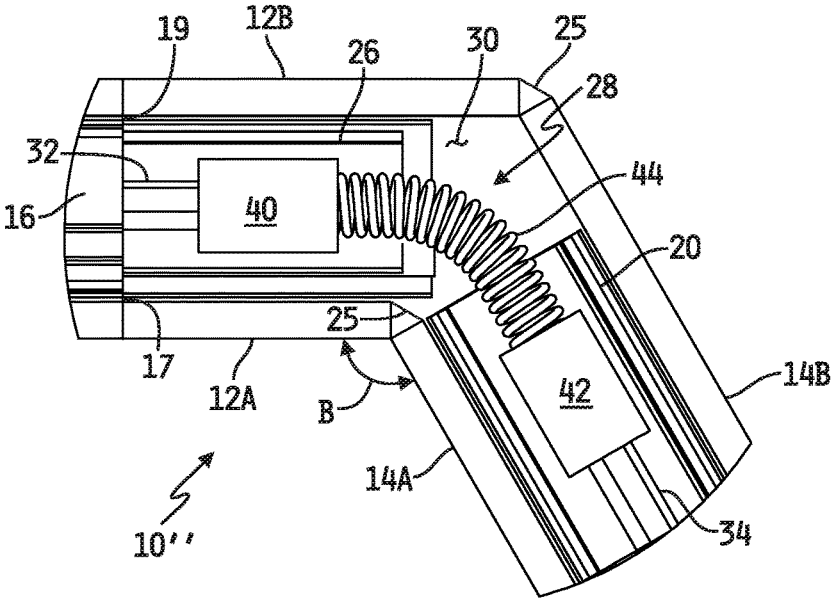
FIG. 5B is a magnified view similar to FIG. 3A illustrating an embodiment of an interface structure for interconnecting the two blind assemblies in the embodiment of the panel unit illustrated in FIG. 5A.
Figure 6A:
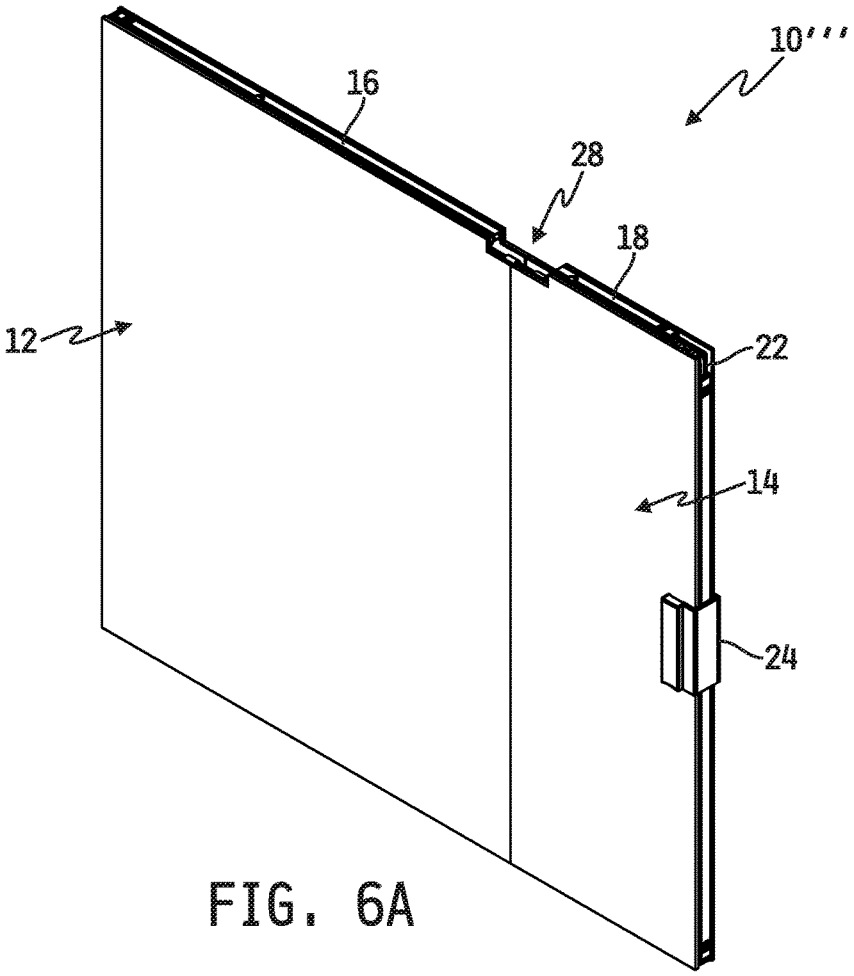
FIG. 6A is a simplified block diagram of yet another embodiment of a panel unit having two interconnected pairs of opposing panels encasing two corresponding interconnected blind assemblies.
Figure 6B:
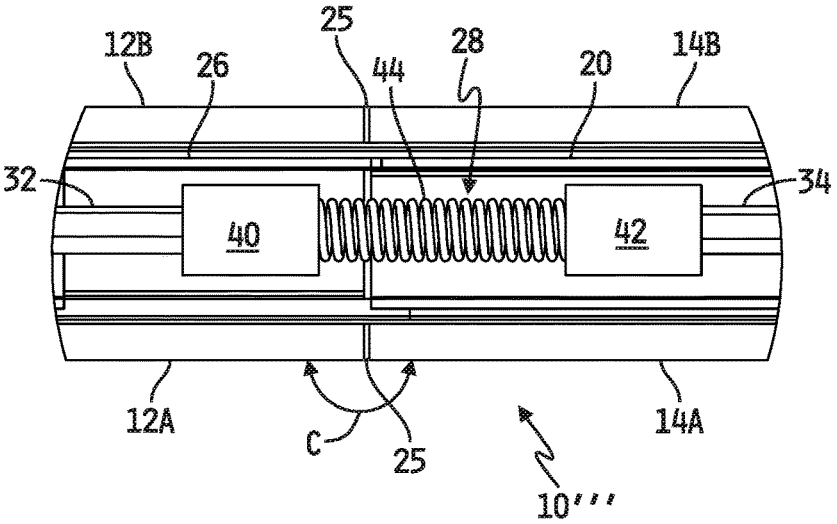
FIG. 6B is a magnified view similar to FIG. 3A illustrating an embodiment of an interface structure for interconnecting the two blind assemblies in the embodiment of the panel unit illustrated in FIG. 6A.

In the embodiments illustrated in FIGS. 1-4, the angle, A, between the planar faces of the panels 12A and 14A is approximately 90 degrees. As briefly described above, however, this disclosure contemplates embodiments in which the angle between the planar faces of the panels 12A, 14A or between the panels 12B, 14B are not 90 degrees or a multiple thereof. In one alternate embodiment of panel unit 10" illustrated in FIGS. 5A and 5B, for example, the panel pairs 12A, 12B and 14A, 14B are arranged such that the planar face of the panel 12A and the planar face of the panel 14A define an angle, B, therebetween which is illustratively an obtuse angle of approximately 120 degrees. In this embodiment, the interface structure 28 is provided in the form of the elongated, flexible member 44 affixed at opposite ends to free ends of the caps 40, 42. As this example illustrates, this form of the interface structure 28 provides the advantage that it may be used without modification for any desired angle between the planar faces of the panels 12A, 14A or between the panels 12B, 14B. If instead the interface structure 28' is used, the slope or angle of the teeth 52A, 56A must be chosen or selected in dependence on the chosen angle between the planar faces of the panels 12A, 14A or between the panels 12B, 14B. Referring to FIGS. 6A and 6B, yet another embodiment of a panel unit 10'" is shown in which the panel pairs 12A, 12B and 14A, 14B are arranged such that the planar face of the panel 12A and the planar face of the panel 14A define an angle, C, therebetween which is illustratively approximately 180 degrees. Again, the interface structure 28 may be used to couple together the drive shafts 32, 34 as illustrated in FIG. 6C, or the interface structure 28' may alternatively be used if modified such that the teeth 52A, 56A are moved to and defined on the ends 52B, 56B respectively of the gears 52, 56.

It will be understood that this disclosure contemplates other conventional structures and mechanisms which may be used to transfer rotational forces between the drive shafts 32, 34 as described above, and the choice of any such structure or mechanism, and the configuration thereof, may depend, at least in part, on the desired angle, A, of the panels 12A, 12B relative to the panels 14A, 14B. It will be further understood that while the units 10, 10', 10", 10'" illustrated and described herein include a pair of interconnected sets of panels 12A, 12B and 14A, 14B, this disclosure contemplates alternate embodiments which may include any number of interconnected panels wherein any to adjacent pairs or sets of panels may define any desired angle between commonly-facing planar faces thereof.

It will be further understood that either or both of the panel pairs 12, 14 may include multiple panels on either side of the unit 10, 10', 10", 10'" with or without one or more films and/or structures, e.g., blind assemblies or other structures, therebetween. Referring to FIG. 7, an example such embodiment is shown in which the panel 12' includes two panels 12A, 12B as described above with respect to FIGS. 1A-6B, and which further includes a second panel 12C juxtaposed with and affixed to the panel 12A and a third panel 12D juxtaposed with and affixed to the panel 12B. The panel 14' likewise includes two panels 14A, 14B as described above with respect to FIGS. 1A-6B, and further includes a second panel 14C juxtaposed with and affixed to the panel 14A and a third panel 14D juxtaposed with and affixed to the panel 14B. A spacer 16' is positioned and affixed to and between the panels 12A, 12C and the panels 12B, 12D, and another spacer 18' is positioned and affixed to and between the panels 14A, 14C and the panels 14B, 14D. In some embodiments, the spacers 16', 18' may represent conventional spacers of the type 16, 18 illustrated and described herein. In other embodiments, the spacers 16', 18' may represent one or more films bonded to some or all of the opposing faces of the corresponding panels. In still other embodiments, the spacers 16', 18' may represent one or more structures affixed to and between the panels 12A, 12C, 12B, 12D, 14A, 14C and 14B, 14D. Examples of such one or more structures may be or include blind assemblies, opaque, translucent or transparent panels, panel grids or other decorative structures, or the like. In any case, it will be understood that one or more of the panels 12A, 12B, 14A, 14B may include two or more juxtaposed panels separated by one or more conventional spacers, films and/or structures.

While the disclosure has been illustrated and described in detail in the drawings and foregoing description, such an illustration and description is to be considered as exemplary and not restrictive in character, it being understood that only illustrative embodiments have been shown and described and that all changes and modifications consistent with the disclosure and recited claims are desired to be protected.

What is claimed is:

1. A panel unit comprising:

a first pair of multiple-edged, juxtaposed panels each defining opposing inner faces and multiple edges, a second pair of multiple-edged, juxtaposed panels each defining opposing inner faces and multiple edges, one of the multiple edges of the first pair of panels joined to one of the multiple edges of the second pair of panels to form an interconnected pair of panels, a spacer joining together the opposing inner faces of the first and second pair of panels about a periphery of the interconnected pair of panels to define an air space between the first pair of panels and the second pair of panels, a first blind assembly positioned in the air space between the first pair of panels, the first blind assembly having a first head rail mounted in the air space between the first pair of panels and near a top edge of the first pair of panels, a first drive shaft carried by the first head rail, and a first set of louvers extending downwardly from the first head rail and coupled to the first drive shaft, the first set of louvers responsive to axial rotation of the first drive shaft to rotate between open and closed positions, a second blind assembly positioned in the air space between the second pair of panels, the second blind assembly having a second head rail mounted in the air space between the second pair of panels and near a top edge of the second pair of panels, a second drive shaft carried by the second head rail, and a second set of louvers extending downwardly from the second head rail, the second set of louvers responsive to axial rotation of the second drive shaft to rotate between open and closed positions, an actuator, and an interface structure rotationally fixing one end of the first drive shaft to one end of the second drive shaft adjacent to joined edges of said one of the multiple edges of the first pair of panels joined to said one of the multiple edges of the second pair of panels, wherein the first and second drive shafts are responsive to a first actuation of the actuator to rotate together to simultaneously rotate the first and second sets of louvers between the open and closed positions thereof.

2. The panel unit of claim 1 wherein one of the first pair of panels defines a first planar face and a corresponding one of the second pair of panels defines a second planar face, and wherein the first and second planar faces define an angle therebetween.

3. The panel unit of claim 2 wherein the angle is one of an acute angle and approximately 90 degrees.

4. The panel unit of claim 2 wherein the angle is one of an obtuse angle and approximately 180 degrees.

5. The panel unit of claim 1 wherein each of the first and second pair of panels is glass.

6. The panel unit of claim 1 wherein the first and second sets of louvers are simultaneously responsive to a second actuation of the actuator to raise and lower relative to the first and second head rails respectively.

7. The panel unit of claim 1 further comprising a first side rail positioned between the first pair of panels along an outer edge thereof, wherein the actuator is movably coupled to the first side rail.

8. A panel unit comprising:

a first pair of multiple-edged, juxtaposed panels each defining opposing inner faces and multiple edges, a second pair of multiple-edged, juxtaposed panels each defining opposing inner faces and multiple edges, one of the multiple edges of the first pair of panels joined to one of the multiple edges of the second pair of panels to form an interconnected pair of panels, a spacer joining together the opposing inner faces of the first and second pair of panels about a periphery of the interconnected pair of panels to define an air space between the first pair of panels and the second pair of panels, a first blind assembly positioned in the air space between the first pair of panels, the first blind assembly having a first head rail mounted in the air space between the first pair of panels and near a top edge of the first pair of panels, a first drive shaft carried by the first head rail, and a first set of louvers extending downwardly from the first head rail and coupled to the first drive shaft, the first set of louvers responsive to axial rotation of the first drive shaft to raise and lower relative to the first head rail, a second blind assembly positioned in the air space between the second pair of panels, the second blind assembly having a second head rail mounted in the air space between the second pair of panels and near a top edge of the second pair of panels, a second drive shaft carried by the second head rail, and a second set of louvers extending downwardly from the second head rail, the second set of louvers responsive to axial rotation of the second drive shaft to raise and lower relative to the second head rail, an actuator, and an interface structure rotationally fixing one end of the first drive shaft to one end of the second drive shaft adjacent to joined edges of said one of the multiple edges of the first pair of panels joined to said one of the multiple edges of the second pair of panels, wherein the first and second drive shafts are responsive to a first actuation of the actuator to rotate together to simultaneously raise or lower the first and second sets of louvers.

9. The panel unit of claim 8 wherein one of the first pair of panels defines a first planar face and a corresponding one of the second pair of panels defines a second planar face, and wherein the first and second planar faces define an angle therebetween.

10. The panel unit of claim 9 wherein the angle is one of an acute angle and approximately 90 degrees.

11. The panel unit of claim 9 wherein the angle is one of an obtuse angle and approximately 180 degrees.

12. The panel unit of claim 8 wherein each of the first and second pair of panels is glass.

13. The panel unit of claim 8 further comprising a first side rail positioned between the first pair of panels along an outer edge thereof, wherein the first actuator is movably coupled to the first side rail.

* * * * *